United States Patent [19]

Campbell et al.

[11] 4,313,121

[45] Jan. 26, 1982

[54] COMPACT MONOPOLE ANTENNA WITH STRUCTURED TOP LOAD

[75] Inventors: Donn V. Campbell, Eatontown; Charles M. DeSantis, Neptune; John R. Wills, Ocean Grove, all of N.J.

[73] Assignee: The United States of America as represented by the Secretary of the Army, Washington, D.C.

[21] Appl. No.: 129,969

[22] Filed: Mar. 13, 1980

[51] Int. Cl.[3] ..... H01Q 9/36

[52] U.S. Cl. ..... 343/790; 343/828; 343/861; 343/899

[58] Field of Search ..... 343/860, 861, 790, 828, 343/829, 830, 899

[56] References Cited

U.S. PATENT DOCUMENTS 3,100,893 8/1963 Brueckmann ..... 343/861

*Primary Examiner*—Eli Lieberman

*Attorney, Agent, or Firm*—Nathan Edelberg; Jeremiah G. Murray; Michael C. Sachs

[57] ABSTRACT

A VHF monopole antenna unit, particularly adapted for operation in the 30–88 MHz frequency range, yet capable of embodiment in a compact structure only approximately 1½ feet in height is described. Coarse tuning is accomplished in a number of switched bands, for each of which is provided a specially designed matching network comprised of inexpensive L-networks of inductors and capacitors. Tuning is accomplished through adjustment of inductor elements. The simple, inexpensive design of the matching circuits eliminates need for intricate mechanisms typically used for automatic impedance matching over a wide band and also for a broadband impedance matching transformer. The compactness made available by the unique top-load structure design is further made possible by provision of a specially designed dielectric filled vertical antenna element, accomplishing the same range and efficiency in an even more compact antenna.

7 Claims, 5 Drawing Figures

COMPACT MONOPOLE ANTENNA WITH COARSE TUNED MATCHING CIRCUITRY

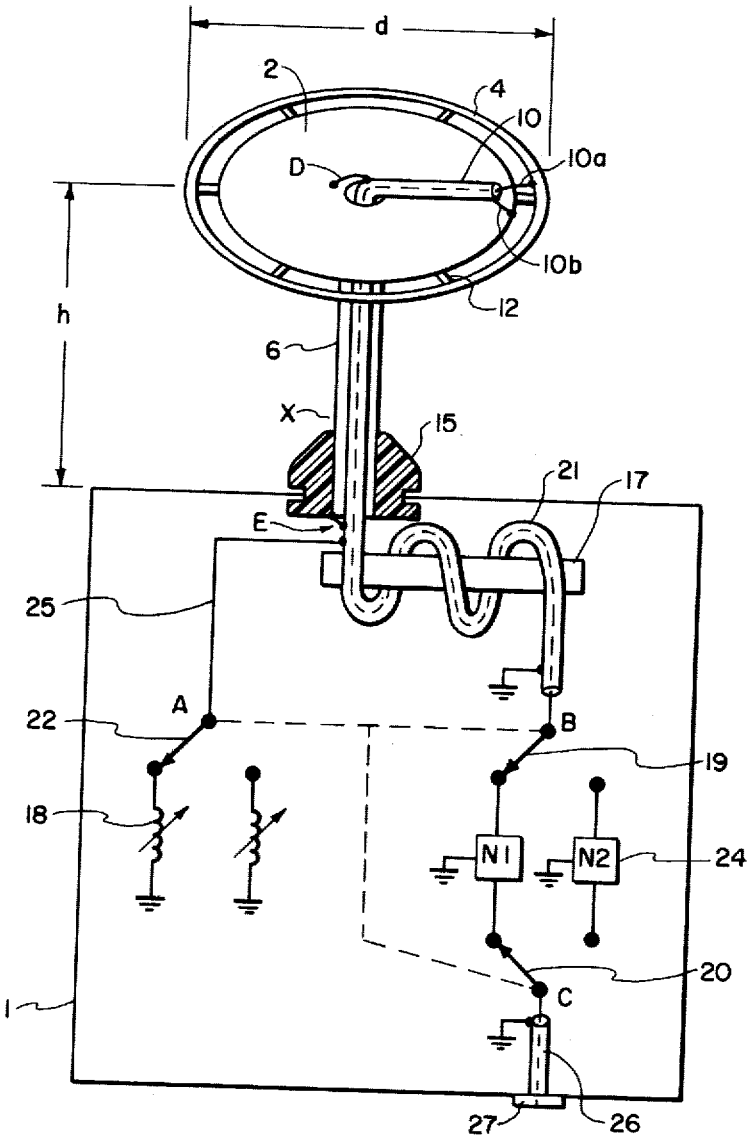
FIG. 1 COMPACT MONOPOLE ANTENNA WITH COARSE TUNED MATCHING CIRCUITRY
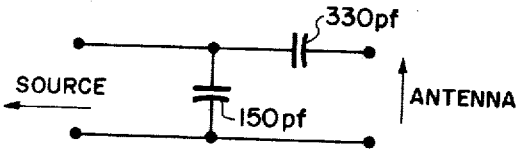
FIG. 2 MATCHING CIRCUIT FOR FIRST BAND (30.0-30.7 MHz)
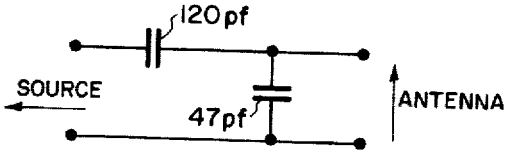
FIG. 3 MATCHING CIRCUIT FOR SECOND BAND (30.7-31.5 MHz)

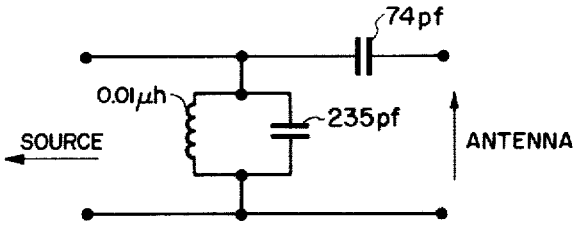
FIG. 4 MATCHING CIRCUIT FOR THIRD BAND (31.6-33.0MHz)
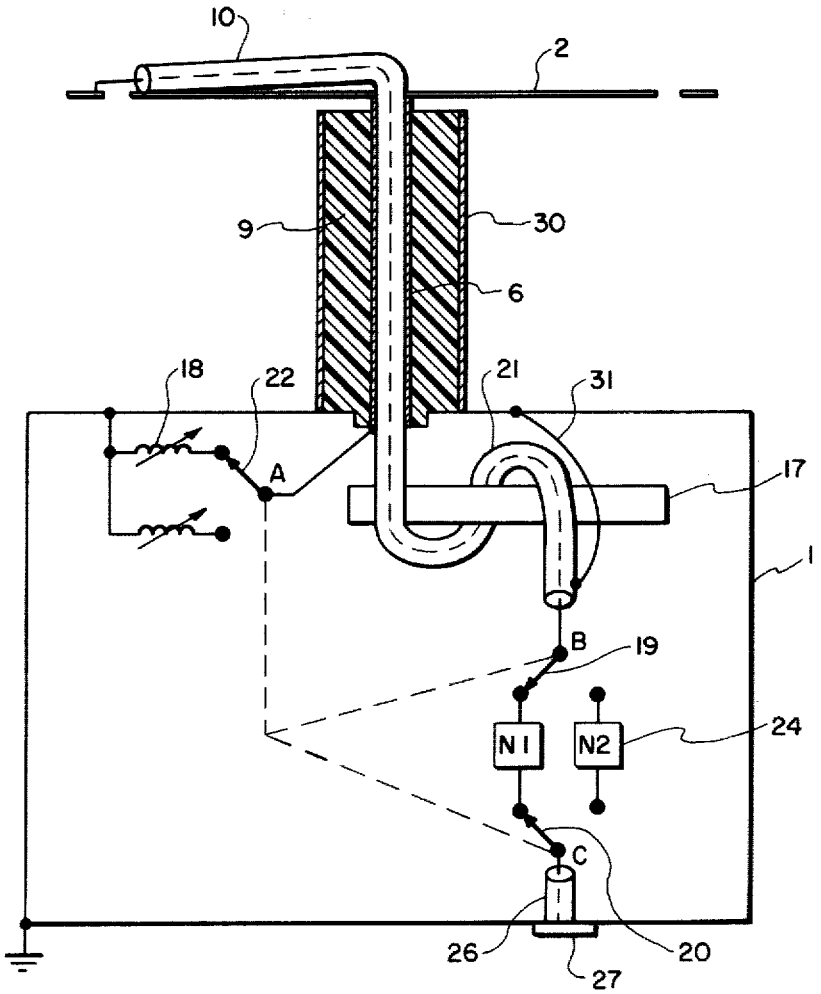
FIG. 5 COMPACT MONOPOLE ANTENNA WITH DIELECTRIC FILLED SLEEVE

COMPACT MONOPOLE ANTENNA WITH STRUCTURED TOP LOAD

The invention described herein may be manufactured and used by or for the Government for governmental purposes without the payment of any roylaties thereon or therefor.

BACKGROUND OF THE INVENTION

This invention relates generally to electrically small top loaded monopole antennas. It is well known that the electrical efficiency of antennas whose maximum dimensions are a small fraction of the wavelength tends to be poor. Moreover, the instantaneous bandwidth of electrically small antennas tends to be relatively narrow so that continuous tuning is often required to establish resonance of the antenna at the frequency of operation. Thus, wide instantaneous bandwidth, high efficiency, and compactness tend to be conflicting requirements in the antenna art.

The present antenna structure provides a good compromise between these three factors. Small antenna size is accomplished which is desired for convenience and to enhance ruggedness. High efficiency eliminates the need for excessive transmitter power and improves signal-to-noise ratio during reception. Moderately wide instantaneous bandwidth simplifies the design of associated tuning and matching networks.

For electrically small antennas such as this, 0.1 λ (wavelength) or less, one would expect at least 20 or more tuning bands to be needed with concomitant number of matching devices needed, such as in the Army AS-1729 antenna. By virtue of the simple, inexpensive design of this structure however, the matching is greatly simplified to perhaps less than 15 bands required. In addition to the simplicity of the matching networks, improvements in compact size and reduced height of the antennas are achieved, owing to the unique construction shown here for the top-load, vertical elements, and grounding schemes.

The use of capacitive top loading and inductive loading is well known to those skilled in the art. For example, U.S. Pat. No. 3,909,830 issued Sept. 30, 1975, and entitled "Tactical High Frequency Antenna", discloses use of such means. The use of an adjustable top load capacitance is disclosed in U.S. Pat. No. 3,530,470 issued Sept. 22, 1970. The use of adjustable cable chokes is taught in U.S. Pat. No. 2,913,722 issued Nov. 17, 1959. This invention is directed to improvements thereover.

Reference is made to the following related applications: "Small Broadband Antennas Using Lossy Matching Networks" by Charles M. DeSantis, Watson P. Czerwinski, Michael W. Begala, Albert H. Zennella and John C. Wills, Ser. No. 142,917, filed April 23, 1980.

SUMMARY OF THE INVENTION

The subject invention is directed to reducing the size of electrically small monopole antennas. In one embodiment, e.g., the antenna is adapted to be coarse tuned in overlapping frequency bands by means of adjustable resonating inductors and matched by means of a structured capacitive top-load and broadband electrical networks. The resonating and matching networks comprising the tuning unit are housed in a protective metal case located at the base of the antenna. The tuning unit can be installed inside the turret of a tank or armored vehicle for protection. The capacitive top-load and the vertical radiating element can be installed to protrude just above the surface of the vehicle platform in such a manner as to be inconspicuous. In the event of ballistic attack, the exposed radiating elements may, on occasion, be destroyed. By virtue of its design, however, the tuning unit, located inside the armored vehicle, can survive such an attack. Installation of a spare radiating element can restore the antenna to operating condition. The low profile of the radiating element contributes to its robustness and survivability. If desired, the radiating elements can be designed with a "breakaway" feature to facilitate repair by replacement.

By raising a feed point to the top-load structure, by adding a cable choke device and in some cases by unique design of the geometry of the top structure and grounding of the vertical antenna elements, the need for elaborate matching units has been reduced. The simple matching units provided eliminate the need for an expensive and extremely difficult-to-design impedance transformer from line to antenna. Additionally, the number of bands for coarse tuning over a wide frequency band is reduced.

OBJECTS

Accordingly, one object of this invention is to provide a more compact, survivable antenna for the VHF frequencies.

Another object is to provide a compact VHF antenna having simplified tuning in a reduced number of bands over the VHF range.

A further object is to provide more simplified, inexpensive matching networks for a compact VHF antenna in a reduced number of bands over a wide VHF frequency range.

A still further object of this invention is to improve the geometry of the top-load structure and vertical structure of a compact VHF antenna, and to make improvements to grounding and feeding of the antenna to still further improve the performance and reduction in size of these antennas.

The foregoing and other objects and advantages of the invention will appear from the following description. In the description, reference is made to the accompanying drawings which form a part hereof, and in which there is shown by way of illustration and not of limitation a preferred embodiment. Such description does not represent the full scope of the invention, but rather the invention may be employed in different arrangements.

DESCRIPTION OF THE DRAWINGS

FIG. 1 is an electrical schematic, partially in block diagrammatic form, illustrative of the essential features of the antenna comprising the subject invention;

FIG. 2 is one embodiment of a first band matching circuit to be used as an element at 24 in FIG. 1;

FIG. 3 is an embodiment of a second band matching circuit to be used as another of the matching circuits at 24 in FIG. 1;

FIG. 4 is a matching circuit of a third band which may also be used at 24 in FIG. 1; and FIG. 5 is an electrical schematic of the small matched antenna in an alternative construction with vertical member comprising dielectric filled metal sleeve and coaxial inner conductors.

DESCRIPTION OF THE PREFERRED EMBODIMENT

With reference to FIG. 1, numeral 1 denotes a metal case which houses the tuning and impedance matching means. The radiating element of the antenna consists of the vertical member 6 which extends from the tuning unit to the top load. The structured top load consists of conducting elements 2 and 4 and insulators 12. The height of the vertical member 6 is denoted by h and the diameter of the structured top load is denoted by d. A coaxial cable transmission line is connected to the top load at 10a and 10b. This connection establishes the antenna feedpoint. The transmission line 10 passes through the interior of the vertical member 6 and an insulator 15 and is wound into a coil 21 on the core 17. The shield of transmission line 10 is connected to the vertical member 6 at the top load at point D and near the base of the insulator 15 at point E. The core 17 may consist of dielectric material or powdered iron or other ferrous material. Moreover, although a cylindrical core 17 is illustrated, it may also be constructed in the shape of a toroid if that configuration is more desirable.

The inner conductor at the lower end of the transmission line 10 is connected to the switch 19 at terminal B. The outer conductor at this end is connected to ground. At the point where the transmission line 10 enters the housing 1 at the bottom of the insulator 15 a connection 25 is made between the shield E of the transmission line 10 and the switch 22 at terminal A. Adjustable inductors 18 are connected between the terminals of switch 22 and ground. In like manner, broadband impedance matching networks 24, such as N1 and N2, are connected between the terminals of switch 19 and switch 20. Typical matching networks for the first three bands are shown in FIGS. 2, 3 and 4 and will be described further. Also the design procedure of these devices is to be outlined further below. Though only N1 and N2 for two bands are shown in FIG. 1, it should be understood that there are further matching circuits and positions on the switches, one for every band. Another transmission line 26 is connected between switch 20 at C and the input connector 27. The radio apparatus is connected at 27. The three switches 19, 22, and 20 are ganged so that they operate together when switching from band to band. The switches may, for example, be remotely controlled and activated by a rotary selector drive. Also, manual control may be used. The switch 22 connects inductors 18 in parallel with inductor 21 to resonate the antenna at the operating frequency. Switches 19 and 20, on the other hand, connect appropriate broadband matching networks 24 in series with the transmission line to achieve an impedance match within a given band.

The broadband matching networks 24 and the inductors 18 are so chosen that the impedance obtained at the connector 27 is compatible with a radio transceiver. For example, the impedance may be such that the voltage standing wave ratio (VSWR) is less than 3. Moreover, the networks 24 and the inductors 18 are so proportioned that overlapping frequency bands are obtained. For example, one band may extend from 40–45 MHz while an adjacent band extends from 44.5 to 52 MHz and so on.

The transmission line 10 is connected to the structured top load at a point where the feedpoint resistance equals (or is approximately equal to) the characteristic impedance of the line. This feature of the structured top load eliminates the need for a broadband transformer and facilitates impedance matching. The impedance obtained with a given antenna structure will depend on the relative size of conductors 2 and 4 and on the height of the vertical member 6 and the wavelength. The impedance transformation is achieved in a novel way by feeding the antenna at a point where the current is small. It is possible to proportion conductors 2 and 4 in such a way that the feedpoint resistance at resonance is comparatively independent of frequency. This feature also facilitates impedance matching and contributes to improved efficiency.

The switches 19, 20 and 22 shown in FIG. 1 show two positions illustrating two bands. Obviously additional switch positions may be required in an antenna covering a wide frequency range. For example, in an antenna covering the VHF frequency range 30–88 MHz, a total of fifteen bands may be employed requiring switches with the same number of positions. As an indication of the size involved in an embodiment of a VHF antenna of this type, the height, h, may be 24 inches and the diameter, d, may be 18 inches. For comparison purposes, an antenna of normal size for the same frequency range is typically 10 feet in length.

If desired, the vertical element 6 can be designed to "breakaway" or separate from the base tuning unit by providing suitable connector means at point X, for example. Such a feature would facilitate repair by replacement of the radiating portion of the antenna without requiring replacement of the base tuning unit. As mentioned earlier, the band selector switches, which are ganged, can be activated by a remotely controlled rotary selector. In this case, the drive mechanism and associated linkages and the electrical wiring and connections can be housed in the matching unit. Details of such means are suppressed in FIG. 1 for clarity. In this connection, the drive shaft, which links the rotary selector to the band selector switches, can also be arranged so that it can be positioned manually.

The top load structure of this invention comprises a disc of one or several circular rings made in one embodiment of aluminum. The top load is typically $\frac{1}{8}''$ thick, though other thicknesses of armour plating might be chosen to withstand battle conditions. The vertical element may be a hollow steel tube, though other types might be used. The dielectric material may be fiberglass, teflon or lucolux materials, for example. The height of the antenna might be as low as $1/20\lambda$. It is noteworthy that so short an antenna (perhaps 18") may replace a large (perhaps 10 foot) bulky and vulnerable antenna. The antenna's height may further be reduced by increasing the diameter of the vertical element. The effective reactance of the antenna, being understood as change in displacement current with respect to ground, is thereby decreased. The height might be shortened without increasing the diameter of the vertical element, but more complex matching circuitry would then be required. One way to shorten the antenna for these frequencies has been shown; that is by provision of the top load structure and base plane. A further improvement in range for the same height antenna is achieved by feeding the antenna at the junction of the top loaded structure and vertical element or better by feeding the antenna on the extremities of the top load element itself. Another improvement is noted when the top-load structure inner disc is grounded while the outer disc is fed. The outer and inner discs are separated by an insulator, which might be bakelite, for example. The feed line is coaxial cable which might be standard RG-58, flexible or rigid, which in one embodiment is fed through the hollow vertical member to reach the top load. The top structure might also be fed at two points thereon which arrangement yield satisfactory results. In addition to feeding of the top load, a further improvement is achieved by addition of a choke for base isolation. By use of both top-load feeding and choke the height of the antenna for the prescribed range needed in these military applications need only be 1/20λ to 1/10λ.

The matching circuit and associated elements are mounted in a grounded metal case into which an input connector is installed. The input signal which must be accommodated typically has an impedance of 50Ω. Ordinarily a broadband transformer would be required to match the antenna structure's varying impedance to these input requirements. However, the matching circuit proposed here and especially feeding the antenna at points where the current is small has avoided the need for the transformer. This is especially beneficial since the design of a proper broadband matching transformer, at these frequencies, might be a formidable task owing to problems of self-inductance of the transformer itself, and high power requirements, perhaps 10–40 watts. The matching circuits of this invention, also to be especially noted, need only provide coarse tuning over the entire approximately 3:1 VHF band. This is quite beneficial for the needs of military personnel. By way of comparison, two types of commercial small broadband antennas come to mind, but it is to be noted that these are very complex designs. Noted are a Continuously-Tuned Capacitive Top Loaded Nonopole Antenna and a Continuously-Tuned Inductive Folded Monopole. Although these devices might not depend on operator intervention for tuning purposes as with this invention, the devices nevertheless depend upon an intricate automatic adjustment done internally. The input impedance of the antenna is continuously monitored over frequency and other changes, and matching is tuned automatically. The involved automatic correction subsystems are completely eliminated by the present invention which is inexpensive by comparison, requiring only simple resistors, capacitors, and/or inductors. The broadband matching networks avoid all the monitoring and correctional circuitry and are more reliable, simple and inexpensive to construct and maintain.

The procedure for designing the matching circuits of network 24 as well as of selecting values for inductor elements 18, and choke 21 is given as follows:

To design the matching networks for the structured top-load antenna shown in FIG. 1, the following procedure is used: the complex impedance of the basic antenna (i.e. without tuning inductors 18, or matching networks 24) is measured at point 19 and plotted on a Smith chart. An inductor 18 of the proper value is then added in parallel with inductor 17 to resonate the antenna, resulting in a new impedance. The leading portion of this new impedance at the first few frequencies is then matched to 50Ω, that is, with a VSWR 3:1 tolerance, by using an L-network.

A typical L-network design for a given frequency starts with the addition of a suitable series capacitance. A parallel capacitance of sufficient susceptance is then added to effect a perfect match. In practice, the 3:1 VSWR tolerance allows a band of frequencies to be matched by a single network simultaneously. Thus, by following the above or similar design procedure, the antenna can be matched in several overlapping bands, any one of which can be selected by switches 19, 20 and 22 of FIG. 1. Examples of L-networks for several bands are shown in FIGS. 2, 3 and 4.

Two equations govern the immitance (impedance or admittance) transformation just described. The magnitude of the immitance of the first element of the network is obtained from $$I_1 = ||Im(I_{ANT})| - |I_p||$$

where Im ($I_{ANT}$) is the imaginary part of the antenna immitance; $I_p$ is given by $$I_p = \sqrt{(Re(I_{ANT}))\,(1-(Re I_{ANT}))}$$

where Re($I_{ANT}$) is the real part of the antenna immitance.

The second element of the network is given by $$I_2 = \sqrt{\frac{(1 - Re(I_{ANT}))}{Re(I_{ANT})}}$$

These equations are derived based upon the achievement of a perfect match (i.e. VSWR = 1:1). More general equations are given in Technical report ECOM-4502, "Low Profile Antenna Performance Study," by C. M. DeSantis, June 1977.

An alternate embodiment of the structured top-load antenna is shown in FIG. 5. Insulator 15 of FIG. 1 is replaced by metal sleeve 30 of FIG. 5. This sleeve is electrically connected at its lower end to case 1, and forms a gap between its top end and top load 2. In addition, sleeve 30 forms the outer conductor of a rigid coaxial line within which metal tube 6 forms the inner conductor. Coil 21 electrically terminates this rigid coaxial line within metal case 1 while the line is open circuited at its upper end. As before, adjustable inductors 18 are also provided to resonate the antenna in the various tuning bands. Electrical connection 31 is made between the inductor 21 and the base of the sleeve to insure a well defined current path inside the case 1. All other features in the embodiment of FIG. 5 follow those shown in FIG. 1.

There are two advantages to be gained, in some cases, by using the antenna of FIG. 5. First of all, the increased diameter of the vertical portion of the antenna is known to increase the bandwidth of an antenna. In a short antenna of the kind being discussed here, the current distribution on the vertical element is not uniform. This nonuniform distribution tends to lower the radiation resistance of the electrically small antenna. The top load greatly improves the uniformity of the current distribution over that of a simple vertical element, but at the lowest operating frequencies the required top load would tend to become too large for practical use and so a compromise is made. Additional loading is provided by the transmission line formed inside the vertical element thereby improving the current distribution.

A second advantage of the added metal sleeve, which forms an inductively terminated coaxial line, is to provide additional inductive loading at the top of the vertical members through the electrical transformation occurring in the coaxial line formed by sleeve 30 and tube 6. The space between sleeve 30 and tube 6 may preferably be dielectric filled by a low loss material such as teflon or lucolux or others. Typical dimensions of the vertical members are 3" inside diameter of sleeve 30, 1" diameter of inner tube 6, with ½" gap between top structure and top of 30; the sleeve may be ⅛" thick. These dimensions vary widely with considerations of, for example, thickness of armour plating for survivability in battle conditions, the sleeve's characteristic impedance and the R.F. voltage.

In addition to the protection of the tuning elements mentioned earlier, the sleeve adds an additional measure of survivability when properly designed. It forms a shield when made of thick armour plating to protect the more vulnerable parts of the antenna from flying debris and blast pressure; and a rigid connection between vehicle, tank, and antenna is provided, further insuring survivability.

What is claimed is:

1. A compact survivable VHF, monopole antenna with top fed capacitive top load having one or more conductive portions and one or more insulating portions, the antenna having a vertical element for supporting the said capacitive top load, one or more of the conductive portions being electrically fed at a point where feedpoint resistance approximately equals characteristic line impedance with one or more conductive portions grounded, said antenna further comprising a matching circuit for impedance matching over a broad frequency range, the circuit comprising:

a number of adjustable inductors and limited band matching units comprising broadband circuits each designed for a given portion of the band, a positional switch manually operable to switch the individual matching units as required for a particular frequency.

2. The antenna of claim 1 wherein the switching of the matching networks and the adjustment of the said inductors are mechanically synchronized.

3. The antenna of claim 2 having a metal tube sleeve for enclosing the vertical member of the antenna structure having the effect of improving its operation by further loading the top regions of the vertical element, and improving its impedance characteristic by reducing the number of switched bands required.

4. The antenna of claim 3 with the sleeve dielectrically filled.

5. The antenna of claim 2 with base choke for inductive loading of the signal line feeding the top load.

6. The antenna of claim 5 where the adjustable inductors are connected to a vertical tube member within the sleeve so as to provide further inductive loading of the signal feed line which passes through the tube.

7. The antenna of claims 2,3,4,5 or 6 wherein the capacitive top load comprises a central disc conductive portion surrounded by a concentric conductive ring portion spaced at a distance by insulator portions the outer ring being electrically fed and the inner disc grounded.

* * * * *